US009503813B2

(12) United States Patent
Li et al.

(10) Patent No.: US 9,503,813 B2
(45) Date of Patent: Nov. 22, 2016

(54) SYSTEM AND METHOD FOR DYNAMIC RESIDUAL NOISE SHAPING

(71) Applicant: 2236008 Ontario Inc., Waterloo (CA)

(72) Inventors: Xueman Li, Burnaby (CA); Phillip Alan Hetherington, Port Moody (CA)

(73) Assignee: 2236008 Ontario Inc., Waterloo (CA)

( * ) Notice: Subject to any disclaimer, the term of this patent is extended or adjusted under 35 U.S.C. 154(b) by 0 days.

(21) Appl. No.: 14/821,364

(22) Filed: Aug. 7, 2015

(65) Prior Publication Data

US 2015/0348568 A1 Dec. 3, 2015

Related U.S. Application Data

(63) Continuation of application No. 13/768,108, filed on Feb. 15, 2013, now Pat. No. 9,137,600.

(60) Provisional application No. 61/599,762, filed on Feb. 16, 2012.

(51) Int. Cl.

| | |
|---|---|
| ***H04R 3/00*** | (2006.01) |
| ***G10L 25/18*** | (2013.01) |
| ***G10L 21/0232*** | (2013.01) |
| *G10L 21/0208* | (2013.01) |
| *G10L 21/0216* | (2013.01) |

(52) U.S. Cl.

CPC ..... *H04R 3/002* (2013.01); *G10L 21/0208* (2013.01); *G10L 21/0232* (2013.01); *G10L 25/18* (2013.01); *G10L 21/0216* (2013.01); *G10L 2021/02087* (2013.01)

(58) Field of Classification Search

None

See application file for complete search history.

(56) References Cited

U.S. PATENT DOCUMENTS

| | | | | |
|---|---|---|---|---|
| 3,921,077 | A | 11/1975 | Suzuki | |
| 4,641,344 | A * | 2/1987 | Kasai | H03G 3/3005 381/57 |
| 5,926,334 | A | 7/1999 | Suzuki | |
| 6,523,003 | B1 * | 2/2003 | Chandran | G10L 21/0208 704/225 |
| 7,844,453 | B2 * | 11/2010 | Hetherington | G10L 21/0208 704/226 |
| 8,015,002 | B2 * | 9/2011 | Li | G10L 21/0208 704/226 |
| 2006/0251268 | A1 | 11/2006 | Hetherington et al. | |
| 2007/0170992 | A1 * | 7/2007 | Cho | H03G 5/005 330/278 |
| 2008/0075300 | A1 * | 3/2008 | Isaka | G10L 21/0208 381/94.2 |
| 2011/0125490 | A1 | 5/2011 | Furuta et al. | |
| 2014/0289630 | A1 * | 9/2014 | Duwenhorst | G11B 27/00 715/727 |

FOREIGN PATENT DOCUMENTS

EP 2 056 296 A2 5/2009

OTHER PUBLICATIONS

European Search Report for corresponding European Application No. 15160720.7 dated Jul. 1, 2015, 5 pages.

* cited by examiner

*Primary Examiner* — Brenda Bernardi
(74) *Attorney, Agent, or Firm* — Brinks Gilson & Lione

(57) ABSTRACT

A system and method for dynamic residual noise shaping configured to reduce hiss noise in an audio signal. The system and method may detect an amount and type of hiss noise. The system and method may limit calculated noise suppression gains responsive to the detected amount and type of hiss noise. The limited noise suppression gains may be applied to the audio signal and may reduce the hiss noise.

19 Claims, 7 Drawing Sheets

— Prior Art — dB
0
-10
-20
402
404
406
304
306
31
63
125
250
500
1000
2000
4000
8000
16000
Hertz

SYSTEM AND METHOD FOR DYNAMIC RESIDUAL NOISE SHAPING

CROSS-REFERENCE TO RELATED APPLICATIONS

This application is a continuation of and claims the benefit of priority to U.S. patent application Ser. No. 13/768,108 and further claims priority to U.S. Provisional Patent Application Ser. No. 61/599,762, filed Feb. 16, 2012, the entirety of both applications are incorporated herein by reference.

BACKGROUND OF THE INVENTION

1. Technical Field

The present disclosure relates to the field of signal processing. In particular, to a system and method for dynamic residual noise shaping.

2. Related Art

A high frequency hissing sound is often heard in wideband microphone recordings. While the high frequency hissing sound, or hiss noise, may not be audible when the environment is loud, it becomes noticeable and even annoying when in a quiet environment, or when the recording is amplified. The hiss noise can be caused by a variety of sources, from poor electronic recording devices to background noise in the recording environment from air conditioning, computer fan, or even the lighting in the recording environment.

BRIEF DESCRIPTION OF DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
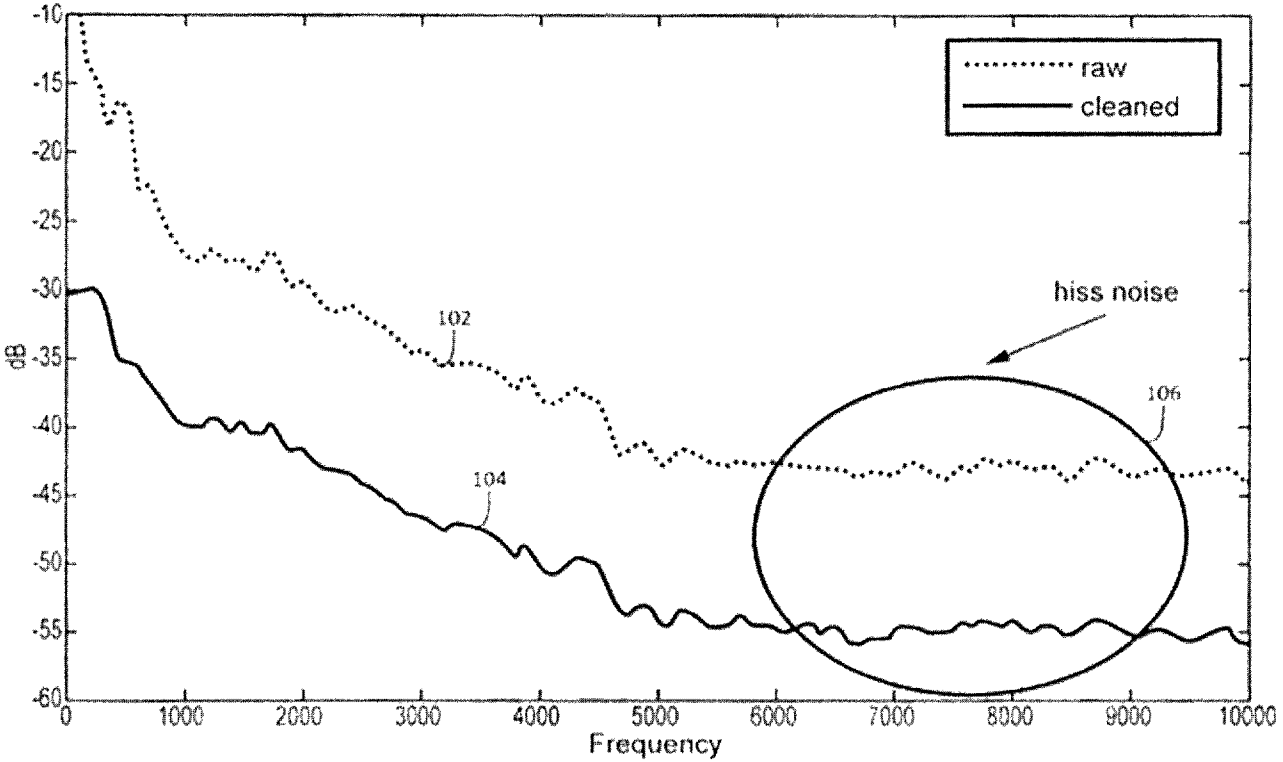
FIG. 1 is a representation of spectrograms of background noise of an audio signal of a raw recording and a conventional noise reduced audio signal.

Disclosed herein are a system and method for dynamic residual noise shaping. Dynamic shaping of residual noise may include, for example, the reduction of hiss noise.

U.S. patent application Ser. No. 11/923,358 filed Oct. 24, 2007 and having common inventorship, the entirety of which is incorporated herein by reference, describes a system and method for dynamic noise reduction. This document discloses principles and techniques to automatically adjust the shape of high frequency residual noise.

In a classical additive noise model, a noisy audio signal is given by $$y(t)=x(t)+n(t) \tag{1}$$

where x(t) and n(t) denote a clean audio signal, and a noise signal, respectively.

Let $|Y_{i,k}|$, $|X_{i,k}|$, and $|N_{i,k}|$ designate, respectively, the short-time spectral magnitudes of the noisy audio signal, the clean audio signal, and noise signal at the $i^{th}$ frame and the $k^{th}$ frequency bin. A noise reduction process involves the application of a suppression gain $G_{i,k}$ to each short-time spectrum value. For the purpose of noise reduction the clean audio signal and the noise signal are both estimates because their exact relationship is unknown. As such, the spectral magnitude of an estimated clean audio signal is given by:

$$|\hat{X}_{i,k}|=G_{i,k}\cdot|Y_{i,k}| \tag{2}$$

Where $G_{i,k}$ are the noise suppression gains. Various methods are known in the literature to calculate these gains. One example further described below is a recursive Wiener filter.

A typical problem with noise reduction methods is that they create audible artifacts such as musical tones in the resulting signal, the estimated clean audio signal $|\hat{X}_{i,k}|$. These audible artifacts are due to errors in signal estimates that cause further errors in the noise suppression gains. For example the noise signal $|N_{i,k}|$ can only be estimated. To mitigate or mask the audible artifacts, the noise suppression gains may be floored (e.g. limited or constrained):

$$\hat{G}_{i,k}=\max(\sigma,G_{i,k}) \tag{3}$$

The parameter σ in (3) is a constant noise floor, which defines a maximum amount of noise attenuation in each frequency bin. For example, when σ is set to 0.3, the system will attenuate the noise by a maximum of 10 dB at frequency bin k. The noise reduction process may produce limited noise suppression gains that will range from 0 dB to 10 dB at each frequency bin k.

The conventional noise reduction method based on the above noise suppression gain limiting applies the same maximum amount of noise attenuation to all frequencies. The constant noise floor in the noise suppression gain limiting may result in good performance for conventional noise reduction in narrowband communication. However, it is not ideal for reducing hiss noise in high fidelity audio recordings or wideband communications. In order to remove the hiss noise, a lower constant noise floor in the suppression gain limiting may be required but this approach may also impair low frequency voice or music quality. Hiss noise may be caused by, for example, background noise or audio hardware and software limitations within one or more signal processing devices. Any of the noise sources may contribute to residual noise and/or hiss noise.

FIG. 1 is a representation of spectrograms of background noise of an audio signal 102 of a raw recording and a conventional noise reduced audio signal 104. The audio signal 102 is an example raw recording of background noise and the conventional noise reduced audio signal 104 is the same audio signal 102 that has been processed with the noise reduction method where the noise suppression gains have been limited by a constant noise floor as described above. The audio signal 102 shows that a hiss noise 106 component of the background noise occurs mainly above 5 kHz in this example, and the hiss noise 106 in the conventional noise reduced audio signal 104 is a lower magnitude but still remains noticeable. The conventional noise reduction process illustrated in FIG. 1 has reduced the level of the entire spectrum by substantially the same amount because the constant noise floor in the noise suppression gain limiting has prevented further attenuation.

Unlike conventional noise reduction methods that do not change the overall shape of background noise after processing, a dynamic residual noise shaping method may automatically detects hiss noise 106 and once hiss noise 106 is detected, may apply a dynamic attenuation floor to adjust the high frequency noise shape so that the residual noise may sound more natural after processing. For lower frequencies or when no hiss noise is detected in an input signal (e.g. a recording), the method may apply noise reduction similar to conventional noise reduction methods described above. Hiss noise as described herein comprises relatively higher frequency noise components of residual or background noise. Relatively higher frequency noise components may occur, for example, at frequencies above 500 Hz in narrowband applications, above 3 kHz in wideband applications, or above 5 kHz in fullband applications.

Figure 2:
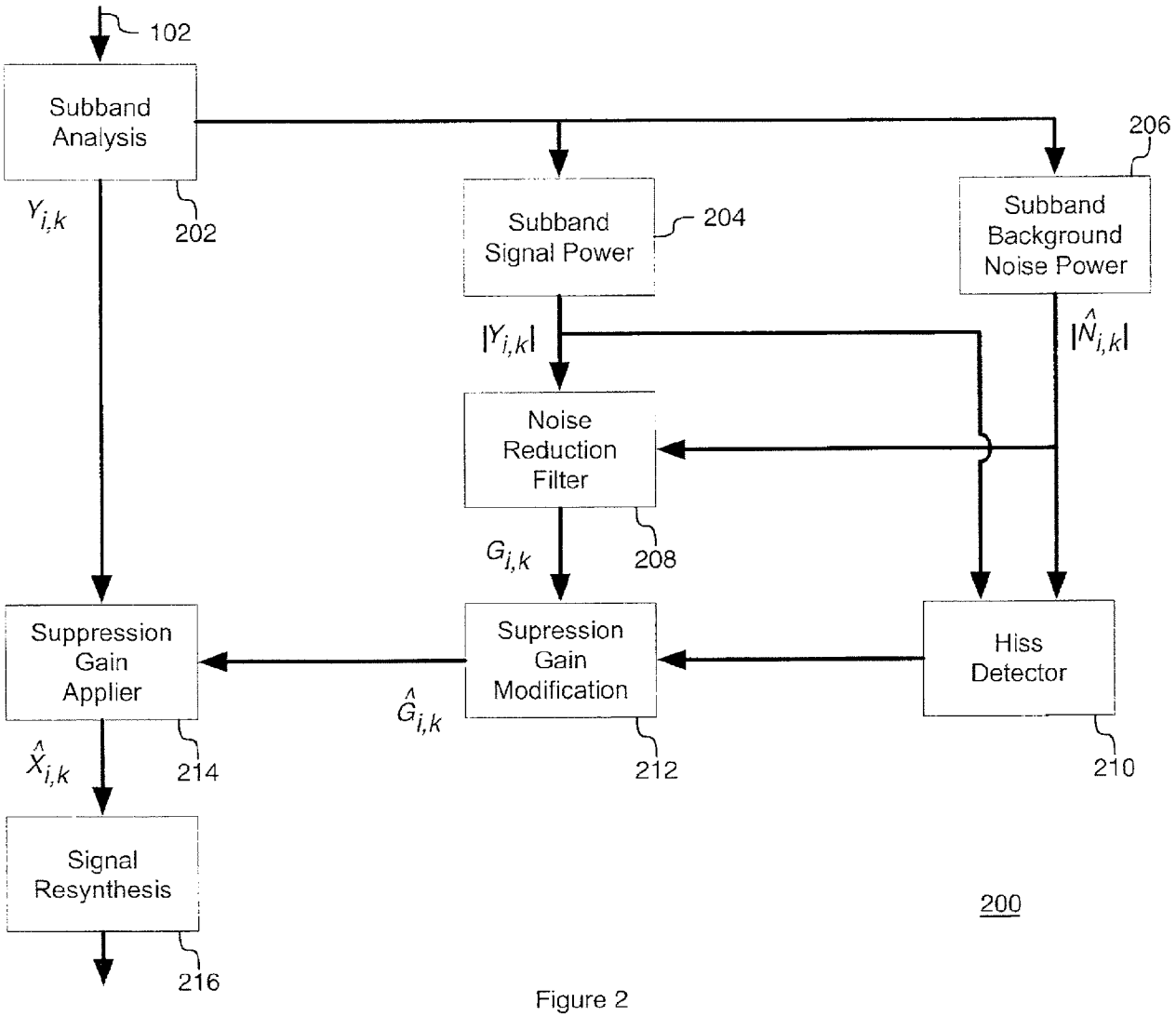
FIG. 2 is a schematic representation of an exemplary dynamic residual noise shaping system.

FIG. 2 is a schematic representation of an exemplary dynamic residual noise shaping system. The dynamic residual noise shaping system 200 may begin its signal processing in FIG. 2 with subband analysis 202. The system 200 may receive an audio signal 102 that includes speech content, audio content, noise content, or any combination thereof. The subband analysis 202 performs a frequency transformation of the audio signal 102 that can be generated by different methods including a Fast Fourier Transform (FFT), wavelets, time-based filtering, and other known transformation methods. The frequency based transform may also use a windowed add/overlap analysis. The audio signal 102, or audio input signal, after the frequency transformation may be represented by $Y_{i,k}$ at the $i^{th}$ frame and the $k^{th}$ frequency bin or each $k^{th}$ frequency band where a band contains one or more frequency bins. The frequency bands may group frequency bins in different ways including critical bands, bark bands, mel bands, or other similar banding techniques. A signal resynthesis 216 performs an inverse frequency transformation of the frequency transformation performed by the subband analysis 202.

The frequency transformation of the audio signal 102 may be processed by a subband signal power module 204 to produce the spectral magnitude of the audio signal $|Y_{i,k}|$. The subband signal power module 204 may also perform averaging of frequency bins over time and frequency. The averaging calculation may include simple averages, weighted averages or recursive filtering.

A subband background noise power module 206 may calculate the spectral magnitude of the estimated background noise $|\hat{N}_{i,k}|$ in the audio signal 102. The background noise estimate may include signal information from previously processed frames. In one implementation, the spectral magnitude of the background noise is calculated using the background noise estimation techniques disclosed in U.S. Pat. No. 7,844,453, which is incorporated in its entirety herein by reference, except that in the event of any inconsistent disclosure or definition from the present specification, the disclosure or definition herein shall be deemed to prevail. In other implementations, alternative background noise estimation techniques may be used, such as a noise power estimation technique based on minimum statistics.

A noise reduction module 208 calculates suppression gains $G_{i,k}$ using various methods that are known in the literature to calculate suppression gains. An exemplary noise reduction method is a recursive Wiener filter. The Wiener suppression gain, or noise suppression gains, is defined as:

$$G_{i,k} = \frac{S\hat{N}R_{priori_{i,k}}}{S\hat{N}R_{priori_{i,k}} + 1}. \tag{4}$$

Where $S\hat{N}R_{priori_{i,k}}$ is the a priori SNR estimate and is calculated recursively by:

$$S\hat{N}R_{priori_{i,k}} = G_{i-1,k} S\hat{N}R_{post_{i,k}} - 1 \tag{5}$$

$S\hat{N}R_{post_{i,k}}$ is the a posteriori SNR estimate given by:

$$S\hat{N}R_{post_{i,k}} = \frac{|Y_{i,k}|^2}{|\hat{N}_{i,k}|^2}. \tag{6}$$

Where $|\hat{N}_{i,k}|$ is the background noise estimate.

A hiss detector module 210 estimates the amount of hiss noise in the audio signal. The hiss detector module 210 may indicate the presence of hiss noise 106 by analyzing any combination of the audio signal, the spectral magnitude of the audio signal $|Y_{i,k}|$, and the background noise estimate $|\hat{N}_{i,k}|$. An exemplary hiss detector method utilized by the hiss detector module 210 first may convert the short-time power spectrum of a background noise estimation, or background noise level, into the dB domain by:

$$B(f) = 20 \log_{10} |N(f)|. \tag{7}$$

The background noise level may be estimated using a background noise level estimator. The dB power spectrum B(f) may be further smoothed in frequency to remove small dips or peaks in the spectrum. A pre-defined hiss cutoff frequency $f_0$ may be chosen to divide the whole spectrum into a low frequency portion and a high frequency portion. The dynamic hiss noise reduction may be applied to the high frequency portion of the spectrum.

Hiss noise 106 is usually audible in high frequencies. In order to eliminate or mitigate hiss noise after noise reduction, the residual noise may be constrained to have a target noise shape, or have certain colors. Constraining the residual noise to have certain colors may be achieved by making the residual noise power density to be proportional to $1/f^{\beta}$. For instance, white noise has a flat spectral density, so $\beta=0$, while pink noise has $\beta=1$, and brown noise has $\beta=2$. The greater the $\beta$ value, the quieter the noise in high frequencies. In an alternative embodiment, the residual noise power density may be a function that has flatter spectral density at lower frequencies and a more slopped spectral density at higher frequencies.

The target residual noise dB power spectrum is defined by:

$$T(f) = B(f_0) - 10\beta \log_{10}(f/f_0) \tag{8}$$

The difference between the background noise level and the target noise level at a frequency may be calculated with a difference calculator. Whenever the difference between the noise estimation and the target noise defined by:

$$D(f) = B(f) - T(f) \tag{9}$$

is greater than a hiss threshold $\delta$, hiss noise is detected and a dynamic floor may be used to do substantial noise suppression to eliminate hiss. A detector may detect when the residual background noise level exceeds the hiss threshold. The dynamic suppression factor for a given frequency above the hiss cutoff frequency $f_0$ may be given by:

$$\lambda(f) = \begin{cases} 10^{0.05D(f)}, & \text{if } D(f) > \delta \\ 1, & \text{otherwise} \end{cases}. \tag{10}$$

Alternatively, for each bin above the hiss cutoff frequency bin $k_0$ the dynamic suppression factor may be given by:

$$\lambda(k) = \begin{cases} 10^{0.05D(k_0)}, & \text{if } D(k_0) > \delta \\ 1, & \text{otherwise} \end{cases}. \tag{11}$$

The dynamic noise floor may be defined as:

$$\eta(k) = \begin{cases} \sigma * \lambda(k), & \text{when } k \geq k_0 \\ \sigma, & \text{when } k < k_0 \end{cases} \tag{12}$$

By combining the dynamic floor described above with the conventional noise reduction method, the color of residual noise may be constrained by a pre-defined target noise shape, and the quality of the noise-reduced speech signal may be significantly improved. Below the hiss cutoff frequency $f_0$, a constant noise floor may be applied. The hiss cutoff frequency $f_0$ may be a fixed frequency, or may be adaptive depending on the noise spectral shape.

A suppression gain limiting module 212 may limit the noise suppression gains according to the result of the hiss detector module 210. In an alternative to flooring the noise suppression gains by a constant floor as in equation (3), the dynamic hiss noise reduction approach may use the dynamic noise floor defined in equation (12) to estimate the noise suppression gains:

$$\hat{G}_{i,k} = \max(\eta(k), G_{i,k}). \tag{13}$$

A noise suppression gain applier 214 applies the noise suppression gains to the frequency transformation of the audio signal 102.

Figure 3:
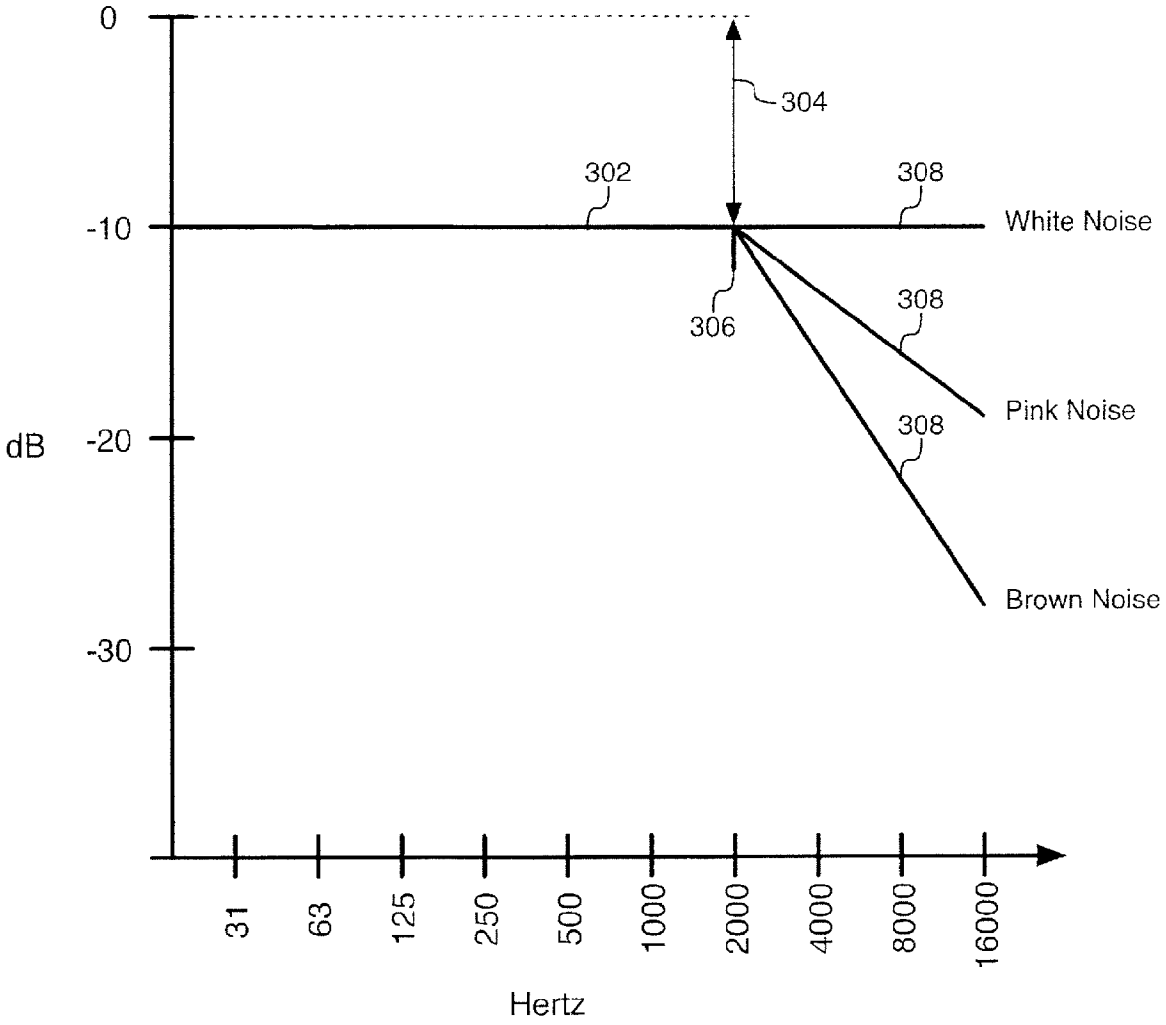
FIG. 3 is a representation of several exemplary target noise shape functions.

FIG. 3 is a representation of several exemplary target noise shape 308 functions. Frequencies above the hiss cutoff frequency 306 may be constrained by the target noise shape 308. The target noise shape 308 may be constrained to have certain colors of residual noise including white, pink and brown. The target noise shape 308 may be adjusted by offsetting the target noise shape 308 by the hiss noise floor 304. Frequencies below the hiss cutoff frequency 306, or conventional noise reduced frequencies 302, may be constrained by the hiss noise floor 304. Values shown in FIG. 3 are illustrative in nature and are not intended to be limiting in any way.

Figures 4A, 4B, 4C:
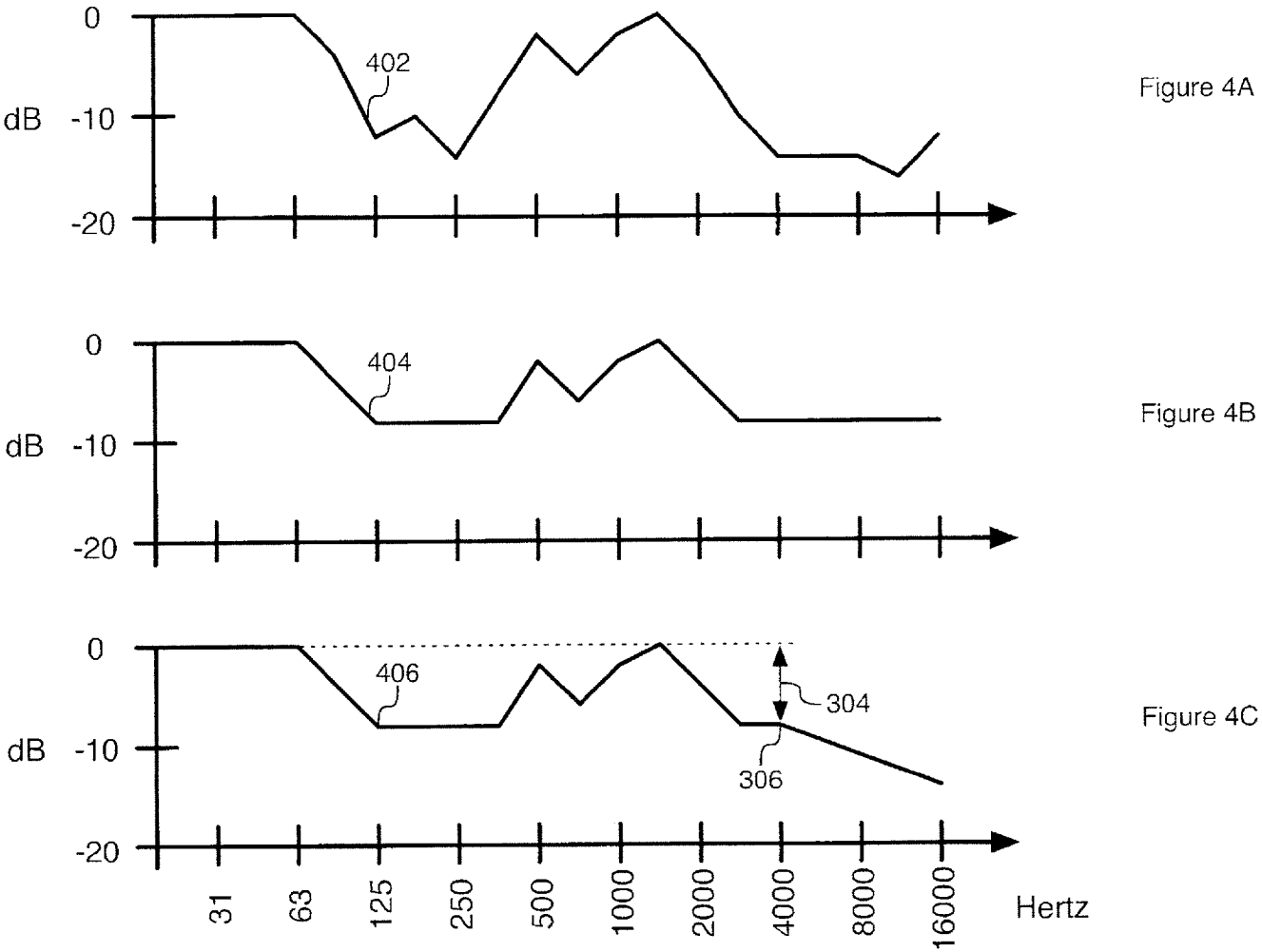
FIG. 4A is a set of exemplary calculated noise suppression gains.
FIG. 4B is the set of exemplary limited noise suppression gains.
FIG. 4C is the set of exemplary hiss noise floored noise suppression gains responsive to the dynamic residual noise shaping process.

FIG. 4A is a set of exemplary calculated noise suppression gains 402. The exemplary calculated noise suppression gains 402 may be the output of the recursive Wiener filter described in equation 4. FIG. 4B is a set of limited noise suppression gains 404. The limited noise suppression gains 404 are the calculated noise suppression gains 402 that have been floored as described in equation 3. Limiting the calculated noise suppression gains 402 may mitigate audible artifacts caused by the noise reduction process. FIG. 4C is a set of exemplary modified noise suppression gains 406 responsive to the dynamic residual noise shaping process. The modified noise suppression gains 406 are the calculated noise suppression gains 402 that have been floored as described in equation 13.

Figure 5:
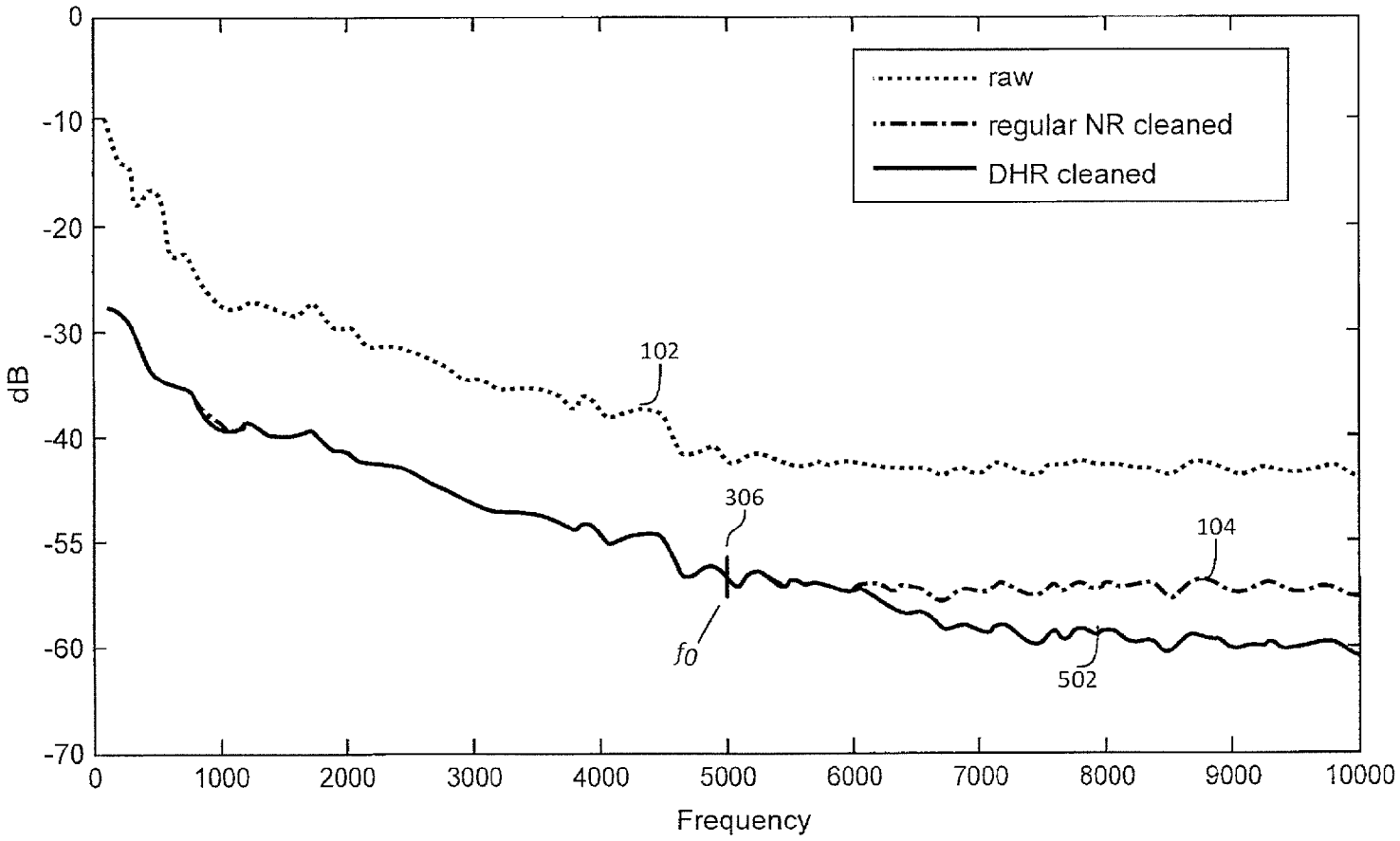
FIG. 5 is a representation of spectrograms of background noise of an audio signal in the same raw recording as represented in FIG. 1 processed by a conventionally noise reduced audio signal and a noised reduced audio signal with dynamic residual noise shaping.

FIG. 5 is a representation of spectrograms of background noise of an audio signal 102 in the same raw recording as represented in FIG. 1 processed by a conventionally noise reduced audio signal 104 and a noise reduced audio signal processed by dynamic residual noise shaping 502. The example hiss cutoff frequency 306 is set to approximately 5 kHz. It can be observed that at frequencies above the hiss cutoff frequency 306 that the noise reduced audio signal with dynamic residual noise shaping 502 may produce a lower noise floor than the noise floor produced by the conventionally noise reduced audio signal 104.

Figure 6:
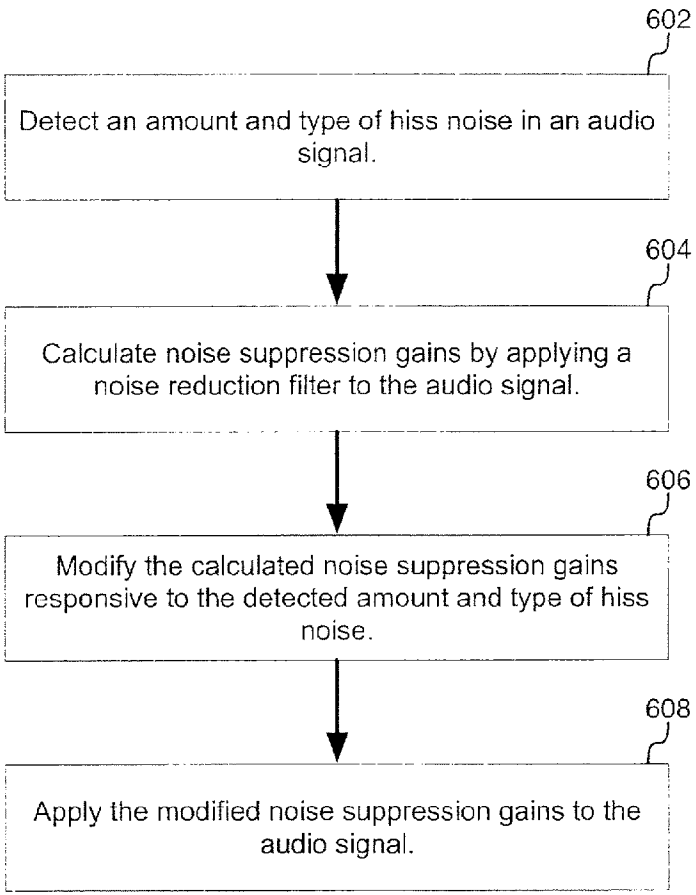
FIG. 6 is flow diagram representing steps in a method for dynamic residual noise shaping in an audio signal.

FIG. 6 is flow diagram representing steps in a method for dynamic residual noise shaping in an audio signal 102. In step 602, the amount and type of hiss noise is detected in the audio signal 102. In step 604, a noise reduction process is used to calculate noise suppression gains 402. In step 606, the noise suppression gains 402 are modified responsive to the detected amount and type of hiss noise 106. Different modifications may be applied to noise suppression gains 402 associated with frequencies below and above a hiss cutoff frequency 306. In step 608, the modified noise suppression gains 406 are applied to the audio signal 102.

The method according to the present description may be implemented by computer executable program instructions stored on a computer-readable storage medium. A system for dynamic hiss reduction may comprise electronic components, analog and/or digital, for implementing the processes described above. In some embodiments the system may comprise a processor and memory for storing instructions that, when executed by the processor, enact the processes described above.

Figure 7:
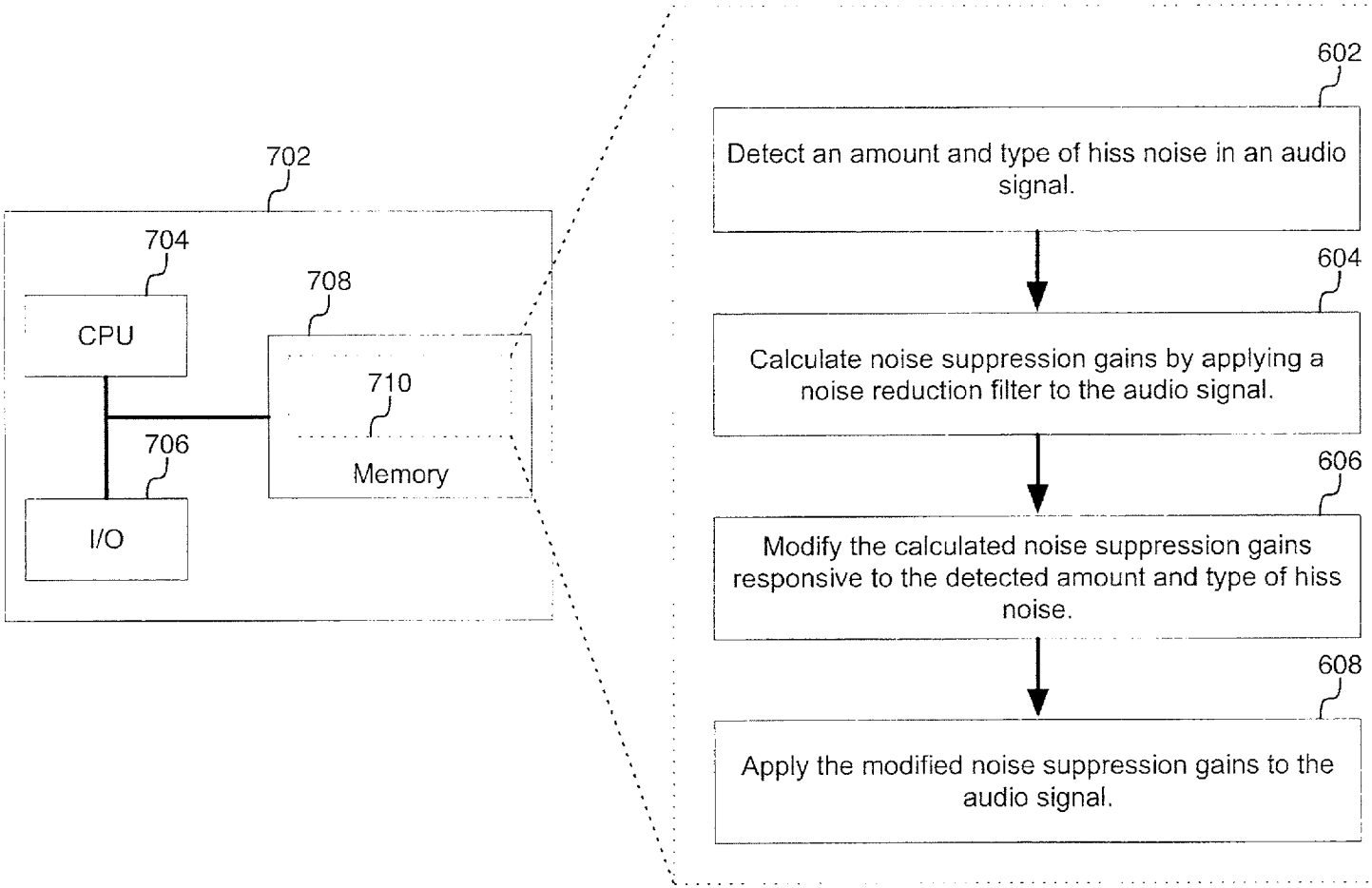
FIG. 7 depicts a system for dynamic residual noise shaping in an audio signal.

FIG. 7 depicts a system for dynamic residual noise shaping in an audio signal 102. The system 702 comprises a processor 704 (aka CPU), input and output interfaces 706 (aka I/O) and memory 708. The processor 704 may comprise a single processor or multiple processors that may be disposed on a single chip, on multiple devices or distribute over more than one system. The processor 704 may be hardware that executes computer executable instructions or computer code embodied in the memory 708 or in other memory to perform one or more features of the system. The processor 704 may include a general processor, a central processing unit, a graphics processing unit, an application specific integrated circuit (ASIC), a digital signal processor, a field programmable gate array (FPGA), a digital circuit, an analog circuit, a microcontroller, any other type of processor, or any combination thereof.

The memory 708 may comprise a device for storing and retrieving data or any combination thereof. The memory 708 may include non-volatile and/or volatile memory, such as a random access memory (RAM), a read-only memory (ROM), an erasable programmable read-only memory (EPROM), or a flash memory. The memory 708 may comprise a single device or multiple devices that may be disposed on one or more dedicated memory devices or on a processor or other similar device. Alternatively or in addition, the memory 708 may include an optical, magnetic (hard-drive) or any other form of data storage device.

The memory 708 may store computer code, such as the hiss detector 210, the noise reduction filter 208 and/or any component. The computer code may include instructions executable with the processor 704. The computer code may be written in any computer language, such as C, C++, assembly language, channel program code, and/or any combination of computer languages. The memory 708 may store information in data structures such as the calculated noise suppression gains 402 and the modified noise suppression gains 406.

The memory 708 may store instructions 710 that when executed by the processor, configure the system to enact the system and method for reducing hiss noise described herein with reference to any of the preceding FIGS. 1-6. The instructions 710 may include the following. Detecting an amount and type of hiss noise 106 in an audio signal of step 602. Calculating noise suppression gains 402 by applying a noise reduction process to the audio signal 102 of step 604. Modifying the noise suppression gains 402 responsive to the detected amount and type of hiss noise 102 of step 606. Applying the modified noise suppression gains 406 to the audio signal 102 of step 608.

All of the disclosure, regardless of the particular implementation described, is exemplary in nature, rather than limiting. The system 200 may include more, fewer, or different components than illustrated in FIG. 2. Furthermore, each one of the components of system 200 may include more, fewer, or different elements than is illustrated in FIG. 2. Flags, data, databases, tables, entities, and other data structures may be separately stored and managed, may be incorporated into a single memory or database, may be distributed, or may be logically and physically organized in many different ways. The components may operate independently or be part of a same program or hardware. The components may be resident on separate hardware, such as separate removable circuit boards, or share common hardware, such as a same memory and processor for implementing instructions from the memory. Programs may be parts of a single program, separate programs, or distributed across several memories and processors.

The functions, acts or tasks illustrated in the figures or described may be executed in response to one or more sets of logic or instructions stored in or on computer readable media. The functions, acts or tasks are independent of the particular type of instructions set, storage media, processor or processing strategy and may be performed by software, hardware, integrated circuits, firmware, micro code and the like, operating alone or in combination. Likewise, processing strategies may include multiprocessing, multitasking, parallel processing, distributed processing, and/or any other type of processing. In one embodiment, the instructions are stored on a removable media device for reading by local or remote systems. In other embodiments, the logic or instructions are stored in a remote location for transfer through a computer network or over telephone lines. In yet other embodiments, the logic or instructions may be stored within a given computer such as, for example, a central processing unit ("CPU").

While various embodiments of the invention have been described, it will be apparent to those of ordinary skill in the art that many more embodiments and implementations are possible within the scope of the present invention. Accordingly, the invention is not to be restricted except in light of the attached claims and their equivalents.

What is claimed is:

1. A dynamic residual noise shaping method, comprising:

detecting an amount and a type of hiss noise in an audio signal;

calculating noise suppression gains by applying a noise reduction filter to the audio signal; and modifying the calculated noise suppression gains by applying a dynamic attenuation floor responsive to the detected amount and type of hiss noise.

2. The method of claim 1, where the act of modifying the calculated noise suppression gains responsive to the detected amount and type of hiss noise further comprises applying the dynamic attenuation floor above a hiss cutoff frequency.

3. The method of claim 1, where the act of modifying the calculated noise suppression gains responsive to the detected amount and type of hiss noise further comprises applying a constant attenuation floor below a hiss cutoff frequency.

4. The method of claim 2, where the hiss cutoff frequency is a fixed frequency.

5. The method of claim 2, where the hiss cutoff frequency is a function of a bandwidth of the audio signal.

6. The method of claim 2, where the hiss cutoff frequency is adaptive responsive to a spectral shape of the hiss noise.

7. The method of claim 1, where detecting an amount and a type of hiss noise in the audio signal further comprises analyzing any of the audio signal, a spectral magnitude of the audio signal and a background noise estimate.

8. The method of claim 1, where modifying the noise suppression gains responsive to the detected amount and type of hiss noise comprises modifying the noise suppression gains to substantially correlate to a target noise shape for each of a plurality of frequency bins of the audio signal.

9. The method of claim 8, where the target noise shape comprises one of a white, a pink or a brown noise.

10. The method of claim 8, where the target noise shape comprises an increasing gain with an increasing frequency.

11. The method of claim 1, where the dynamic attenuation floor is applied for each of a plurality of frequency bins of the audio signal when a difference between a noise estimate and a target noise exceeds a hiss threshold for each respective frequency bin of the audio signal.

12. The method of claim 11, further comprising:

applying the modified noise suppression gains to the audio signal to reduce the amount of hiss noise in the audio signal.

13. A system for dynamic residual noise shaping, the system comprising:

a processor;

a memory coupled to the processor containing instructions, executable by the processor, programmed to:

detect an amount and a type of hiss noise in an audio signal;

calculate noise suppression gains by applying a noise reduction filter to the audio signal; and modify the calculated noise suppression gains by applying a dynamic attenuation floor responsive to the detected amount and type of hiss noise.

14. The system of claim 13, where the program that modifies the calculated noise suppression gains responsive to the detected amount and type of hiss noise further applies the dynamic attenuation floor above a hiss cutoff frequency.

15. The system of claim 13, where the program that modifies the calculated noise suppression gains responsive to the detected amount and type of hiss noise further applies a constant attenuation floor below a hiss cutoff frequency.

16. The system of claim 14, where the hiss cutoff frequency comprises a fixed frequency.

17. The system of claim 14, where the hiss cutoff frequency comprises a function of a bandwidth of the audio signal.

18. The system of claim 14, where the hiss cutoff frequency comprises an adaptive response to a spectral shape of the hiss noise.

19. The system of claim 13, where the program that detects the amount and the type of hiss noise in the audio signal further analyzes any of the audio signal, a spectral magnitude of the audio signal and a background noise estimate.

* * * * *